US006604331B1

(12) United States Patent
Pallas et al.

(10) Patent No.: US 6,604,331 B1
(45) Date of Patent: Aug. 12, 2003

(54) BASEBOARD MOLDING STRIP UNIT

(76) Inventors: Steven Pallas, 176 Linwell Road, St. Catharine's, Ontario (CA), L2N-6N3; Paul E. McKee, 22 Christina Street, St. Catharine's, Ontario (CA), L2T-2R7

( * ) Notice: Subject to any disclaimer, the term of this patent is extended or adjusted under 35 U.S.C. 154(b) by 0 days.

(21) Appl. No.: 10/191,235

(22) Filed: Jul. 9, 2002

(51) Int. Cl.[7] ..... E04B 2/00

(52) U.S. Cl. ..... 52/287.1; 52/288.1; 52/290; 52/718.01; 52/718.04; 52/480

(58) Field of Search ..... 52/287.1, 288.1, 52/290, 718.01, 718.04, 718.02, 480, 255; 104/275

(56) References Cited

U.S. PATENT DOCUMENTS

| | | | | |
|---|---|---|---|---|
| 4,622,791 A | | 11/1986 | Cook et al. | |
| 4,845,910 A | | 7/1989 | Hanson et al. | |
| 5,740,642 A | * | 4/1998 | Koenig et al. | 52/255 |
| RE35,971 E | * | 11/1998 | Kessler | 52/718.04 |
| 6,134,854 A | * | 10/2000 | Stanchfield | 52/480 |
| 6,189,276 B1 | | 2/2001 | Pinto et al. | |
| 6,202,565 B1 | * | 3/2001 | Henry | 104/275 |
| 2002/0178684 A1 | * | 12/2002 | Barnett | |

OTHER PUBLICATIONS

Patent Publication No.: GB 2236777 A Apr. 1991 Catherine Holland.*

* cited by examiner

*Primary Examiner*—Carl D. Friedman
*Assistant Examiner*—Nahid Amiri
(74) *Attorney, Agent, or Firm*—Donald R. Schoonover

(57) ABSTRACT

An area between a wall and a floor of a building can be covered by a baseboard molding unit of the present invention. The baseboard molding unit of the present invention includes a wall-mounted track section that can be fixed to a wall by fasteners and which includes a dovetail joint element and a baseboard element that has a dovetail groove defined therein that is slidably, yet securely held on the dovetail joint element. Corner pieces are used for inside and for outside corners.

5 Claims, 2 Drawing Sheets

BASEBOARD MOLDING STRIP UNIT

BACKGROUND OF THE INVENTION

1. Field of the Invention

The present invention relates to the general art of static structures, and to the particular field of trim or shield members at corners of static structures.

2. Discussion of the Related Art

In nearly all habitable buildings, the areas where upright walls join floors may be unsightly when the building is first constructed. This unsightliness is generally created during the rough construction of the building and must be covered for the finished building. Molding strips are generally applied to the walls adjacent to the intersection of the wall and the floor to cover these unsightly areas. These molding strips are generally fixed to the wall using some sort of adhesive or mechanical fasteners. This requires skill, patience, care and experience. If not properly applied, a molding may have to be removed or repaired, either of which can be difficult and time consuming, and may be especially onorous if a contractor is required to remove improperly placed molding and replace it with new molding at his own expense.

If adhesive is used, the molding may have to be removed in strips with a great deal of clean-up work completed before new molding is placed on the wall. Not only are materials lost, time is consumed.

Pry bars and the like are often required to remove molding. When molding is removed in this manner, there is danger of damaging a floor or the wall adjacent to the molding. Damage to a floor or a wall is undesirable under most circumstances, but certainly in circumstances when a finished floor is damaged during removal of improperly placed molding. Painted or papered walls are also quite susceptible to damage during removal of molding.

It is sometimes necessary to remove molding for repair of the molding itself, or for repair or rework of the wall or the floor. If the molding is securely fixed to the wall, such desired removal may be very difficult or nearly impossible.

Therefore, there is a need for a baseboard molding strip unit that can be easily and accurately placed. There is a further need for a baseboard molding strip unit that can be easily removed and replaced if necessary.

Furthermore, in some cases, properly applied molding may still have gaps. This is especially true when a floor has been remodeled with a new finished product. It can be difficult and exacting work to apply molding to such gaps.

Therefore, there is a need for a baseboard molding unit that can be applied in a wide variety of situations.

Many people do their own work, i.e., are "do-it-yourselfers." Such people may be quite skilled in many areas, but it is nearly impossible to be highly skilled in all phases of home modeling or re-modeling work. Thus, it is advantageous if work can be made as easy as possible for an unskilled person to achieve a finished product closely approaching the product that a highly skilled expert could achieve. This is especially true for finish work, including molding in a building. Such a product would benefit skilled and experienced workers as well.

Therefore, there is a need for a baseboard molding unit that can be applied by an unskilled person in a manner that can achieve a finished appearance approaching that achievable by a skilled person.

Room corners are an especially difficult area for proper placement of baseboard molding. Even skilled and experienced craftsman often find it difficult to properly place molding near room corners. This is especially troublesome for an unskilled or inexperienced person.

Therefore, there is a need for a baseboard molding unit that can be accurately, yet easily placed near room corners.

OBJECTS OF THE INVENTION

It is a main object of the present invention to provide a baseboard molding strip unit that can be easily and accurately placed.

It is another object of the present invention to provide a baseboard molding strip unit that can be easily removed and replaced if necessary.

It is another object of the present invention to provide a baseboard molding unit that can be applied in a wide variety of situations.

It is another object of the present invention to provide a baseboard molding unit that can be applied by an unskilled person in a manner that can achieve a finished appearance approaching that achievable by a skilled person.

It is another object of the present invention to provide a baseboard molding unit that can be accurately, yet easily placed near room corners.

SUMMARY OF THE INVENTION

These, and other, objects are achieved by a baseboard molding strip unit which includes a wall-mounted track section fixed to a wall adjacent to a floor when in a set-up configuration and which includes a dovetail joint element; a baseboard element having a groove defined therein, with the groove being shaped and sized to snugly yet slidably receive the dovetail joint element on the wall-mounted track section in a snap-on manner; and fasteners releasably fastening the wall-mounted track section to the wall in the set-up configuration.

The wall-mounted track section is easily fixed to a wall, yet can easily be removed if necessary. Any marring of the wall near the molding unit caused by either placement or removal of the wall unit can be covered by the baseboard element. Thus, re-finish work is minimized for several reasons, including ease of initial placement, ease of removal and an ability to cover marred surfaces. Pry bars and hammers are not required as nails and/or screws can be used because they will be covered by the baseboard in the set-up configuration.

The unit of the present invention also includes corner pieces that can be fixed to either an inner or an outer corner and the remainder of the unit is easily modified to accommodate the corner pieces. Thus, placing molding near room corners is quite easily accomplished, even by an unskilled or inexperienced workman.

DETAILED DESCRIPTION OF THE INVENTION

Other objects, features and advantages of the invention will become apparent from a consideration of the following detailed description and the accompanying drawings.

The baseboard molding unit of the present invention is easily placed and removed and easily accommodates room corners. The unit also covers most imperfections associated with placement or removal of the unit whereby such operations can be efficiently carried out.

A baseboard molding unit 10 of the present invention includes a floor surface 12 and an upright wall surface 14 adjacent to floor surface 12. The surfaces 12 and 14 can be formed of any suitable material and generally form the floor and adjacent wall of a room in a building.

Figure 1:
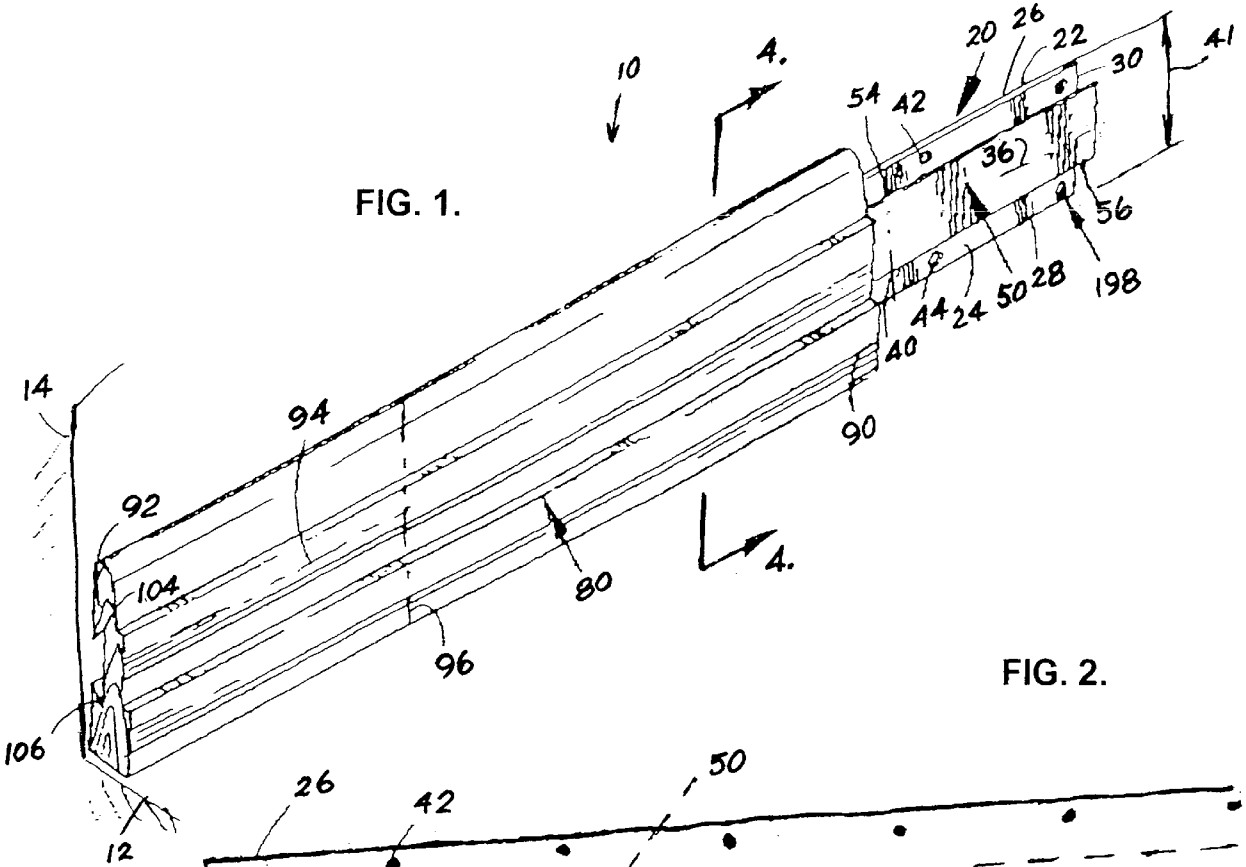
FIG. 1 is a perspective view of a wall-mounted track section and a baseboard element of the baseboard molding unit embodying the present invention.
Figure 2:
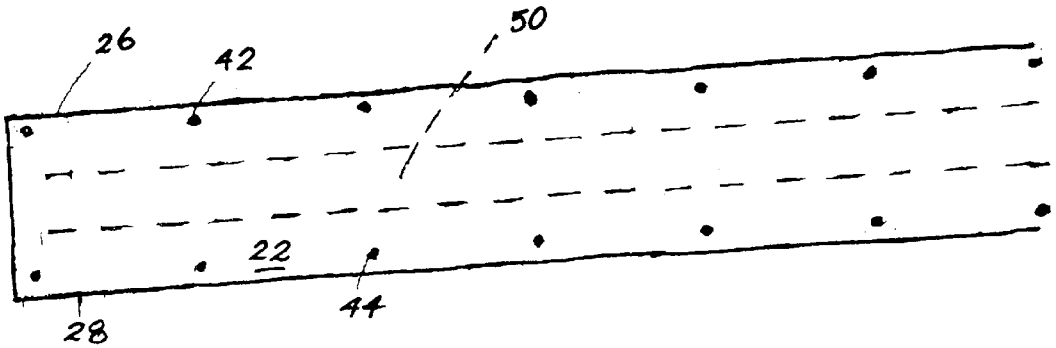
FIG. 2 is a rear elevational view of the combination shown in FIG. 1.

Molding unit 10 further includes a wall-mounted track section 20 having a rear surface 22 which abuts upright wall surface 14 when wall-mounted track section 20 is mounted on upright wall surface 14 and a front surface 24. Wall-mounted track section 20 can be formed of any suitable material, such as metal or the like. Since adhesive is not needed to mount section 20 on a wall, the material of section 20 need not be selected with adhesion to the wall as a factor. Section 20 further includes a first side edge 26, a second side edge 28 that is located adjacent to floor surface 12 when wall-mounted track section 20 is mounted on upright wall surface 14, a first end edge 30, a second end edge (hidden in FIG. 1), a longitudinal axis 36 extending from first end edge 30 of wall-mounted track section 20 to the second end edge of wall-mounted track section 20, and a transverse axis 40 extending from first side edge 26 of wall-mounted track section 20 to second side edge 28 of wall-mounted track section 20. A transverse dimension, designated by the numeral 41 in FIG. 1, is defined between side edges 26 and 28 along transverse axis 40. Wall-mounted track section 20 further includes a plurality of first fastener-receiving holes 42 defined through wall-mounted track section 20 from front surface 24 to rear surface 22, the first fastener-receiving holes 42 being spaced apart from each other along longitudinal axis 36 of wall-mounted track section 20. Unit 20 further includes a plurality of second fastener-receiving holes 44 defined through wall-mounted track section 20 from front surface 24 to rear surface 22. Second fastener-receiving holes 44 being spaced apart from each other along longitudinal axis 36 of wall-mounted track section 20. Associated first and second fastener-receiving holes 42 and 44 are spaced apart from each other along transverse axis 40 of wall-mounted track section 20.

Baseboard molding strip unit 10 further includes a dovetail joint element 50 on front surface 24 of wall-mounted track section 20. Dovetail joint element 50 extends along longitudinal axis 36 of wall-mounted joint section 20 from first end 30 to the second end of wall-mounted joint section 20 and is positioned between first side edge 26 and second side edge 28 of wall-mounted joint section 20. Dovetail joint element 50 has a front surface 52 which is spaced apart from front surface 24 of wall-mounted track section 20, a first edge 54 which is spaced from first side edge 26 of wall-mounted track section 20 and spaced from front surface 24 of the wall-mounted track section, a second edge 56 which is spaced from second side edge 28 of wall-mounted track section 20 and spaced from front surface 24 of wall-mounted track section 20. Dovetail joint element 50 further includes a first angled edge 60 connecting first edge 54 of front surface 52 of dovetail joint element 50 to front surface 24 of wall-mounted track section 20 and is oriented at oblique angles to front surface 52 of the dovetail joint element 50 and front surface 24 of the wall-mounted track section. The angled orientation of edge 60 causes that edge to form a first angled corner 62 with first edge 54 of front surface 52 of dovetail joint element 50 and a second angled corner 64 with front surface 24 of wall-mounted track section 20.

Dovetail joint element 20 further includes a second angled edge 70 connecting second edge 56 of front surface 52 of dovetail joint element 50 to front surface 24 of wall-mounted track section 20 and is oriented at oblique angles to front surface 52 of the dovetail joint element 50 and front surface 24 of wall-mounted track section 20 and forms a third angled corner 72 with second edge 56 of front surface 52 of dovetail joint element 50 and a fourth angled corner 74 with front surface 24 of the wall-mounted track section 20. Dovetail joint element 50 is positioned between first fastener-receiving holes 42 and second fastener-receiving holes 44 and has a base 76 on front surface 24 of the wall-mounted track section 20.

Baseboard molding strip unit 10 further includes a baseboard element 80 which includes a rear surface 82 which is positioned adjacent to wall-mounted track section 20 when baseboard element 80 is mounted on wall-mounted track section 20, a front surface 84, a first side edge 86, a second side edge 88, a first end edge 90, a second end edge 92, a longitudinal axis 94 extending between the first and second end edges 90 and 92 of baseboard element 80 and a transverse axis 96 extending between the first and second side edges 86 and 88 of baseboard element 80. Baseboard molding strip 80 has a transverse dimension defined along transverse axis 96 between side edges 86 and 88, designated by the numeral 98 in FIG. 3. As can be seen in FIG. 1, transverse dimension 98 of the baseboard element is greater than transverse dimension 41 of the wall-mounted track section. This allows the baseboard molding strip to cover the wall-mounted track section 20 when unit 10 is in the set up configuration. This permits marring of the wall during set up to be covered and covers any fasteners used to fix the wall-mounted track section 20 to the wall 14.

Baseboard molding strip 80 further includes a dovetail groove 100 defined in rear surface 82 of the baseboard element to extend along longitudinal axis 94 of the baseboard element 80. Dovetail groove 100 has an inside surface 102 spaced from rear surface 82 of baseboard element 80 and which abuts front surface 52 of dovetail joint element 50 when baseboard element 80 is mounted on wall-mounted track section 20. Inside surface 102 of dovetail groove 100 includes a first side edge 104 and a second side edge 106, a first angled edge 108 connecting first side edge 104 of inside surface 102 of the dovetail groove 100 to rear surface 82 of baseboard element 80 and which forms a first angled corner 110 with inside surface 102 of dovetail groove 100 and which abuts first angled corner 62 of dovetail joint element 50 when the baseboard element 80 is mounted on the wall-mounted track section 20. Dovetail groove 100 further includes a second angled edge 112 connecting second side edge 106 of inside surface 102 of dovetail groove 100 to rear surface 82 of baseboard element 80 and which forms a second angled corner 114 with inside surface 102 of the dovetail groove which abuts third angled corner 72 of dovetail joint element 50 when baseboard element 80 is mounted on wall-mounted track section 20.

Figure 4:
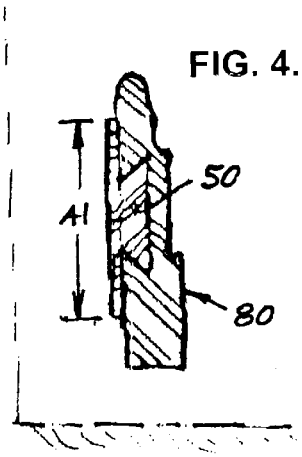
FIG. 4 is an enlarged, side elevational view taken along line 4—4 of FIG. 1 and similar to FIG. 3, with the baseboard element connected to the wall-mounted track section.

Dovetail groove 100 further includes a third angled corner 116 located between first angled edge 108 of the dovetail groove 100 and rear surface 82 of baseboard element 80 and which abuts the second angled corner 64 of dovetail joint element 50 when baseboard element 80 is mounted on wall-mounted track section 20. Dovetail groove 100 further includes a fourth angled corner 118 located between second angled edge 112 of the dovetail groove 100 and rear surface 82 of the baseboard element 80 and which abuts fourth angled corner 74 of the dovetail joint element 50 when the baseboard element 80 is mounted on the wall-mounted track section 20. As shown in FIG. 4, rear surface 82 of baseboard element 80 abuts front surface 24 of wall-mounted track section 20 when the baseboard element 80 is mounted on the wall-mounted track section 20.

Fasteners, such as screws 198, nails or the like are accommodated in holes 42 and 44 to attach wall-mounted track section 20 to surface 14.

Figure 7:
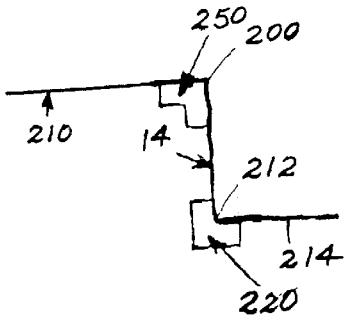
FIG. 7 is a plan view of a corner arrangement showing an inside corner and an outside corner.

As shown in FIG. 7, adjacent upright walls can include an inside corner 200, as shown between surfaces 14 and 210 and an outside corner 212 as shown between surfaces 14 and 214.

Accordingly, baseboard molding unit 10 includes an outside corner piece 220 shown in FIG. 7 as having a first portion 222 which has a rear surface 224 which abuts side wall surface 214 when outside corner piece 220 is mounted on side wall surface 214. First portion 222 of outside corner piece 220 also includes an outside surface 226. Outside corner piece 220 further includes a second portion 230 which has a rear surface 232 which is in abutting engagement with upright wall surface 14 when outside corner piece 220 is mounted on upright wall surface 14. Second portion 230 further includes an outside surface 234.

First and second portions 222 and 230 of outside corner piece 220 intersect each other to form a corner 240 which is located adjacent to outside corner 212 formed at the intersection between side wall surface 214 and upright wall surface 14 when outside corner piece 220 is mounted on upright wall surface 14 and on side wall surface 214. Outside corner piece 220 further includes a first shoulder 244 on outside surface 226 of first portion 222 of outside corner piece 220, and a second shoulder 246 on outside surface 234 of second portion 230 of outside corner piece 220.

Figure 5:
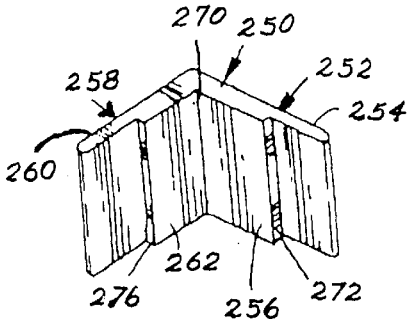
FIG. 5 is a perspective view of an inside corner element.
Figure 6:
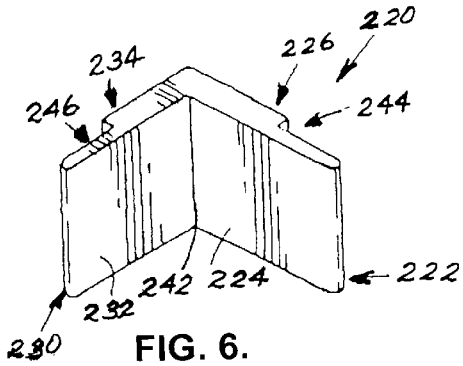
FIG. 6 is a perspective view of an outside corner element.

The baseboard molding unit 10 further includes an inside corner piece 250 shown in FIG. 5 as having a first portion 252 which has an outside surface 254 which is in abutting engagement with inside wall surface 210 when inside corner piece 250 is mounted on inside wall surface 210. Inside corner piece 250 further includes an inside surface 256 on first portion 252. Inside corner piece 250 further includes a second portion 258 which has an outside surface 260 which is in abutting engagement with wall surface 210 when inside corner piece 250 is mounted on wall surface 210. Second portion 258 also has an inside surface 262 on second portion 258.

First and second portions 252 and 258 of inside corner piece 250 intersect each other to form a corner 270 which is located adjacent to inside corner 200 formed at the intersection between inside wall surface 210 and upright wall surface 14 when inside corner piece 250 is mounted on upright wall surface 14 and on inside wall surface 210. Inside corner piece 250 further includes a first shoulder 272 on inside surface 256 of first portion 252 of inside corner piece 250, and a second shoulder 276 on inside surface 262 of second portion 258 of inside corner piece 250.

The shoulders on the corner pieces accommodate the wall-mounted track sections 20 so the baseboard elements will smoothly engage the corner pieces.

Figure 3:
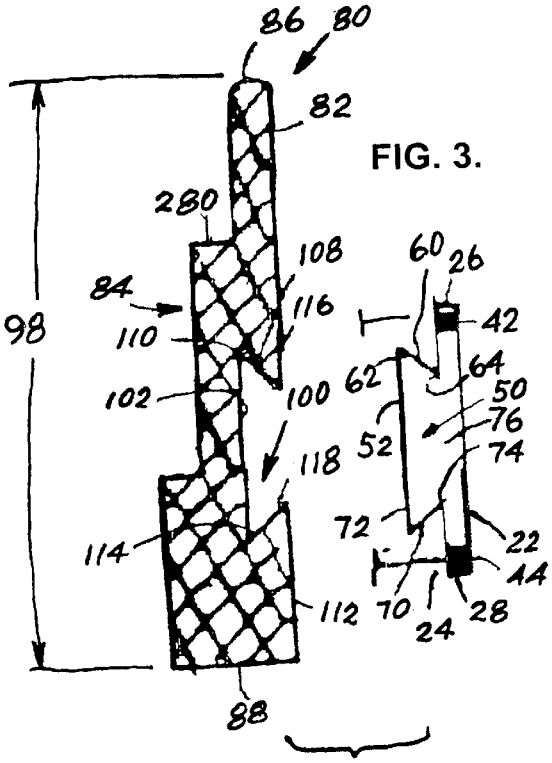
FIG. 3 is an enlarged, side elevational view of the combination shown in FIG. 1 with the baseboard element separated from the wall-mounted track section.

As shown in FIGS. 1 and 3, one form of baseboard element 80 includes a plurality of front shoulders 280 which form a decorative front for the mounted baseboard molding unit.

As can be understood from the foregoing, a method of finishing a wall using the unit of the present invention comprises providing a baseboard molding strip unit 10 which includes a wall-mounted track section 20 and which has a dovetail joint element 50 and a transverse dimension 41 and a baseboard element 80 which includes a dovetail groove 100 defined therein to slidably accommodate the dovetail joint element and having a transverse dimension 98 which is greater than the transverse dimension 41 of the wall-mounted track section; releasably mounting the wall-mounted track section on a wall; sliding the dovetail groove of the baseboard element onto the dovetail element of the wall-mounted track section in a "snap-on" manner; and covering the wall-mounted track section with the baseboard element.

It is understood that while certain forms of the present invention have been illustrated and described herein, it is not to be limited to the specific forms or arrangements of parts described and shown.

We claim:

1. A baseboard molding unit comprising:

a) a floor surface;

b) an upright wall surface adjacent to said floor surface;

c) a wall-mounted track section having (1) a rear surface which abuts said upright wall surface when said wall-mounted track section is mounted on said upright wall surface, (2) a front surface, (3) a first side edge, (4) a second side edge located adjacent to said floor surface when said wall-mounted track section is mounted on said upright wall surface, (5) a first end edge, (6) a second end edge, (7) a longitudinal axis extending from the first end edge of said wall-mounted track section to the second end edge of said wall-mounted track section, (8) a transverse axis extending from the first side edge of said wall-mounted track section to the second side edge of said wall-mounted track section, the wall-mounted track section having a transverse dimension defined along the transverse axis of the wall-mounted track section from the first side edge to the second side edge of the wall-mounted track section, (9) a plurality of first fastener-receiving holes defined through said wall-mounted track section from the front surface to the rear surface, the fastener-receiving holes of the first plurality of fastener-receiving holes being spaced apart from each other along the longitudinal axis of said wall-mounted track section,

(10) a plurality of second fastener-receiving holes defined through said wall-mounted track section from the front surface to the rear surface, the fastener-receiving holes of the second plurality of fastener-receiving holes being spaced apart from each other along the longitudinal axis of said wall-mounted track section,

(11) associated fastener-receiving holes in the first and second plurality of fastener-receiving holes being spaced apart from each other along the transverse axis of said wall-mounted track section,

(12) a dovetail joint element on the front surface of said wall-mounted track section, said dovetail joint element (A) extending along the longitudinal axis of said wall-mounted joint section from the first end to the second end of said wall-mounted joint section, (B) being positioned between the first side edge and the second side edge of said wall-mounted joint section, (C) having a front surface which is spaced apart from the front surface of said wall-mounted track section, (D) a first edge which is spaced from the first side edge of said wall-mounted track section and spaced from the front surface of said wall-mounted track section, (E) a second edge which is spaced from the second side edge of said wall-mounted track section and spaced from the front surface of said wall-mounted track section, (F) a first angled edge connecting the first edge of the front surface of the dovetail joint element to the front surface of said wall-mounted track section and being oriented at oblique angles to the front surface of the dovetail joint element and the front surface of said wall-mounted track section and forming a first angled corner with the first edge of the front surface of the dovetail joint element and a second angled corner with the front surface of said wall-mounted track section, (G) a second angled edge connecting the second edge of the front surface of the dovetail joint element to the front surface of said wall-mounted track section and being oriented at oblique angles to the front surface of the dovetail joint element and the front surface of said wall-mounted track section and forming a third angled corner with the second edge of the front surface of the dovetail joint element and a fourth angled corner with the front surface of said wall-mounted track section, (H) being positioned between the first plurality of fastener-receiving holes and the second plurality of fastener-receiving holes, and (I) having a base on the front surface of said wall-mounted track section; and d) a baseboard element which includes (1) a rear surface which is positioned adjacent to said wall-mounted track section when said baseboard element is mounted on said wall-mounted track section, (2) a front surface, (3) a first side edge, (4) a second side edge, (5) a first end edge, (6) a second end edge, (7) a longitudinal axis extending between the first and second end edges of said baseboard element, (8) a transverse axis extending between the first and second side edges of said baseboard element, the base board element having a transverse dimension defined along the transvere axis of the baseboard element from the first side edge of the baseboard element to the second side edge of the baseboard element, (9) the transverse dimension of the baseboard element being greater than the transverse dimension of the wall-mounted track section,

(10) a dovetail groove defined in the rear surface of said baseboard element to extend along the longitudinal axis of said baseboard element and (A) having an inside surface spaced from the rear surface of said baseboard element and abutting the front surface of the dovetail joint element when said baseboard element is mounted on said wall-mounted track section, the inside surface of the dovetail groove including a first side edge and a second side edge, (B) a first angled edge connecting the first side edge of the inside surface of the dovetail groove to the rear surface of said baseboard element and forming a first angled corner with the inside surface of the dovetail groove which abuts the first angled corner of the dovetail joint element when said baseboard element is mounted on said wall-mounted track section, (C) a second angled edge connecting the second side edge of the inside surface of said dovetail groove to the rear surface of said baseboard element and forming a second angled corner with the inside surface of the dovetail groove which abuts the third angled corner of the dovetail joint element when said baseboard element is mounted on said wall-mounted track section, (D) a third angled corner located between the first angled edge of the dovetail groove and the rear surface of the baseboard element and which abuts the second angled corner of the dovetail joint element when said baseboard element is mounted on said wall-mounted track section, and (E) a fourth angled corner located between the second angled edge of the dovetail groove and the rear surface of the baseboard element and which abuts the fourth angled corner of the dovetail joint element when said baseboard element is mounted on said wall-mounted track section; and e) the rear surface of said baseboard element abutting the front surface of said wall-mounted track section when said baseboard element is mounted on said wall-mounted track section.

2. The baseboard molding strip unit as described in claim 1 further including a plurality of fasteners.

3. The baseboard molding strip unit as described in claim 1 further including a side wall surface intersecting said upright wall surface;

an outside corner formed at the intersection between said side wall surface and said upright wall surface; and an outside corner piece having (1) a first portion which has a rear surface which is in abutting engagement with said side wall surface when said outside corner piece is mounted on said side wall surface and an outside surface, (2) a second portion which has a rear surface which is in abutting contact with said upright wall surface when said outside corner piece is mounted on said upright wall surface and an outside surface, (3) the first and second portions of said outside corner piece intersecting each other to form a corner which is located adjacent to said outside corner formed at the intersection between said side wall surface and said upright wall surface when said outside corner piece is mounted on said upright wall surface and on said side wall surface, (4) a first shoulder on the outside surface of the first portion of said outside corner piece, and (5) a second shoulder on the outside surface of the second portion of said outside corner piece.

4. The baseboard molding strip unit defined in claim 1 further including an inside wall surface intersecting said upright wall surface;

an inside corner formed at the intersection between said inside side wall surface and said upright wall surface; and an inside corner piece having (1) a first portion which has an outside surface which is in abutting engagement with said upright wall surface when said inside corner piece is mounted on said upright wall surface and an inside surface, (2) a second portion which has an outside surface which is in abutting engagement with said inside wall surface when said inside corner piece is mounted on said inside wall surface and an inside surface, (3) the first and second portions of said inside corner piece intersecting each other to form a corner which is located adjacent to said inside corner formed at the intersection between said inside wall surface and said upright wall surface when said inside corner piece is mounted on said upright wall surface and on said inside wall surface, (4) a first shoulder on the inside surface of the first portion of said inside corner piece, and (5) a second shoulder on the inside surface of the second portion of said inside corner piece.

5. The baseboard molding strip unit as described in claim 2 further including a plurality of front shoulders on the front surface of said baseboard element, said front shoulders extending along the longitudinal axis of said baseboard element.

* * * * *